US010711806B2

(12) United States Patent
Boscher

(10) Patent No.: US 10,711,806 B2
(45) Date of Patent: Jul. 14, 2020

(54) NOZZLE MODULE FOR AN ENERGY CONVERTER

(71) Applicant: Matthias Boscher, Marktoberdorf (DE)

(72) Inventor: Matthias Boscher, Marktoberdorf (DE)

( * ) Notice: Subject to any disclaimer, the term of this patent is extended or adjusted under 35 U.S.C. 154(b) by 752 days.

(21) Appl. No.: 15/311,109

(22) PCT Filed: May 19, 2015

(86) PCT No.: PCT/EP2015/060971
§ 371 (c)(1),
(2) Date: Nov. 14, 2016

(87) PCT Pub. No.: WO2015/177130
PCT Pub. Date: Nov. 26, 2015

(65) Prior Publication Data

US 2017/0074108 A1 Mar. 16, 2017

(30) Foreign Application Priority Data

May 19, 2014 (DE) ..... 10 2014 107 038

(51) Int. Cl.
*F04F 5/46* (2006.01)
*F04F 5/24* (2006.01)
(Continued)

(52) U.S. Cl.
CPC ..... *F04F 5/463* (2013.01); *F04F 5/10* (2013.01); *F04F 5/24* (2013.01); *F01D 25/00* (2013.01)

(58) Field of Classification Search
CPC .. F01D 9/02; F01D 25/00; F01D 25/32; F04F 5/463; F04F 5/10; F04F 5/461; F04F 5/24; F05D 2240/128; F05D 2210/11
See application file for complete search history.

(56) References Cited

U.S. PATENT DOCUMENTS 1,748,004 A * 2/1930 Urquhart ..... B05B 7/04 134/102.1
3,314,236 A * 4/1967 Zanoni ..... F04F 5/467 60/654

(Continued)

FOREIGN PATENT DOCUMENTS

| | | |
|---|---|---|
| EP | 1808588 A1 | 7/2007 |
| GB | 426 596 A | 4/1935 |
| GB | 1092511 A | 11/1967 |

OTHER PUBLICATIONS

International Search Report for PCT/EP2015/060971 filed on May 19, 2015.

*Primary Examiner* — Nathan C Zollinger
(74) *Attorney, Agent, or Firm* — Notaro, Michalos & Zaccaria P.C.

(57) ABSTRACT

A nozzle module for an energy converter, in particular for a power plant, including a first nozzle for the introduction of a motive fluid into a mixing chamber and an introduction opening for the introduction of a suction fluid into the mixing chamber, the mixing chamber having a geometry for merging the motive fluid and the suction fluid in the mixing chamber in a flow-intensifying manner. To specify a nozzle module which effects an increase in efficiency of the power plant, a vapor pressure of the motive fluid upstream of the first nozzle is lower than a vapor pressure of the suction fluid upstream of the introduction opening, and a gas pressure in the mixing chamber in a region downstream of the first nozzle is lower than a gas pressure in the mixing chamber in a region downstream of the introduction opening.

9 Claims, 2 Drawing Sheets

Figure 1:
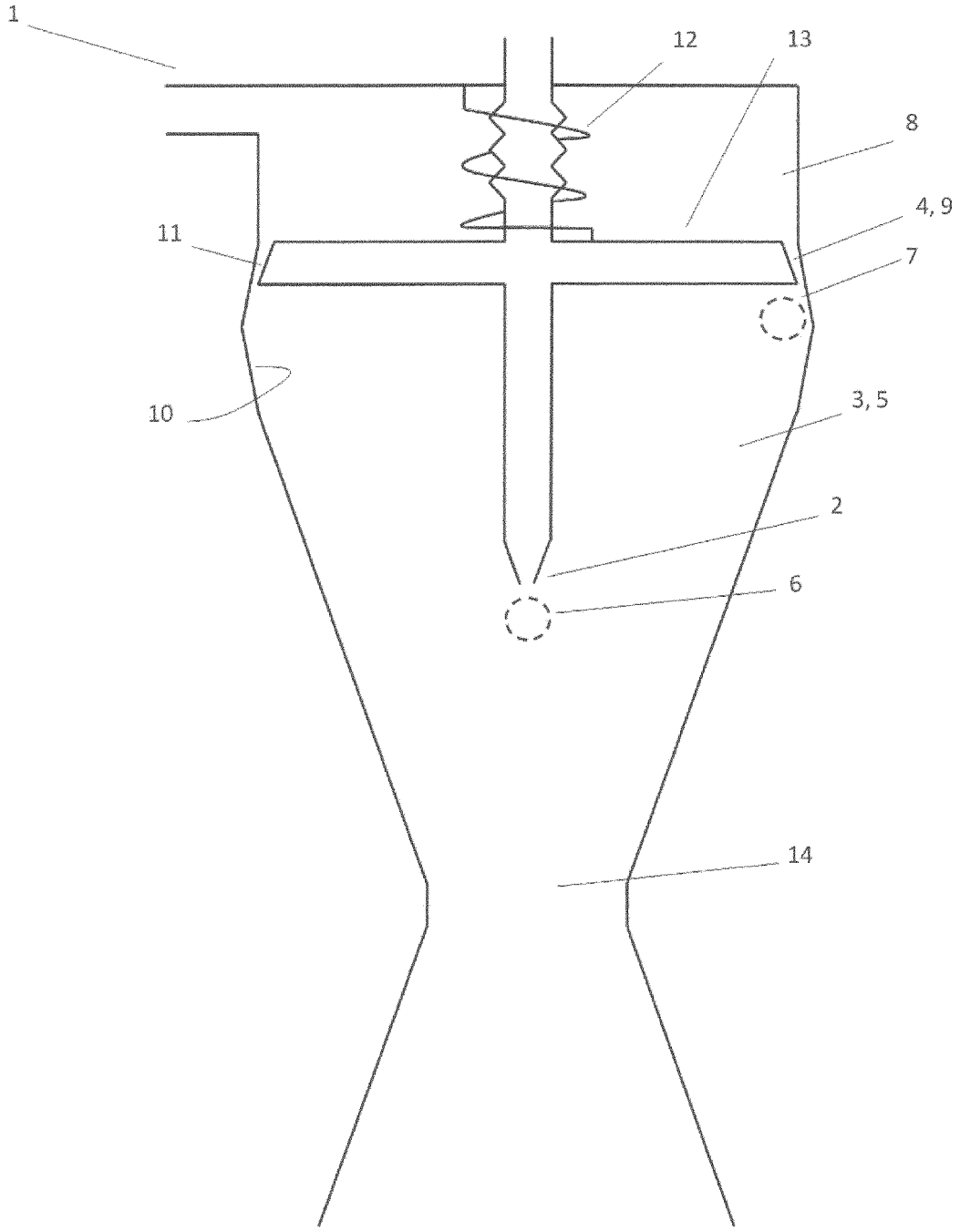

(51) Int. Cl.
*F04F 5/10* (2006.01)
*F01D 25/00* (2006.01)

(56) References Cited

U.S. PATENT DOCUMENTS 3,423,011 A * 1/1969 Stepp ..... F04F 5/461
417/187
3,511,259 A * 5/1970 Toure ..... F02C 7/236
137/114
3,831,855 A * 8/1974 Mocarski ..... F04F 5/461
239/416
3,922,113 A * 11/1975 Turner ..... F04C 15/062
417/79
4,051,680 A * 10/1977 Hall ..... F01K 19/08
60/689
5,032,059 A * 7/1991 McCall ..... F04F 5/461
4/541.3
5,586,442 A * 12/1996 Nicodemus ..... F04F 5/00
62/107
5,794,447 A * 8/1998 Nicodemus ..... F01K 19/08
417/197
2014/0134007 A1* 5/2014 Koith ..... B60K 15/035
417/191

* cited by examiner

NOZZLE MODULE FOR AN ENERGY CONVERTER

The present invention relates to a nozzle module for an energy converter, in particular for a power plant, comprising a first nozzle for the introduction of a motive fluid into a mixing chamber and comprising an introduction opening for the introduction of a suction fluid into the mixing chamber, the mixing chamber having a geometry for merging the motive fluid and the suction fluid in the mixing chamber in a flow-intensifying manner.

In the case of energy converters, such as for example thermal power plants and in particular steam power plants, it is often the case that fluids are separated and merged in order to effect temperature changes or changes in the state of aggregation of the fluids. The aim of such separation and merging is generally to generate a fluid jet which has a high temperature, a high flow speed or, in the best case, a high temperature and a high flow speed. This energy-rich fluid jet serves for driving a turbine which is connected to a generator for the generation of electrical energy. However, the separation and merging of fluids requires energy, for example for pumping the fluids, which comes at the expense of the efficiency of the power plant.

It is therefore an object of the present invention to specify a nozzle module of the type mentioned in the introduction which effects an increase in the efficiency of the power plant.

To achieve said object, the invention proposes a nozzle module of the type mentioned in the introduction, wherein a vapor pressure of the motive fluid upstream of the first nozzle is lower than a vapor pressure of the suction fluid upstream of the introduction opening, and a gas pressure in the mixing chamber in a region downstream of the first nozzle is lower than a gas pressure in the mixing chamber in a region downstream of the introduction opening. Owing to the relatively high vapor pressure of the suction fluid, said suction fluid evaporates more easily than the motive fluid, and may, after flowing through the introduction opening, be present in gaseous form in the region downstream of the introduction opening. In the region downstream of the introduction opening, a gas pressure prevails which is higher than the gas pressure in the region downstream of the first nozzle. The possibly gaseous fluid is, owing to the pressure gradient provided according to the invention between the region downstream of the first nozzle and the region downstream of the introduction opening, caused to accelerate in the direction of the region downstream of the first nozzle, in which the motive fluid exits the first nozzle. In the region downstream of the first nozzle, or at the latest at a discharge opening of the mixing chamber, the motive fluid and the suction fluid are merged, wherein an energy of the suction fluid is transferred to the motive fluid. In other words, an inflow of the suction fluid gives rise to an energy enrichment of the motive fluid. This introduction of energy into the motive fluid may be based in particular on two principles. Firstly, the atoms or molecules of the suction fluid have an amount of intrinsic energy which is not directional and which, upon the merging with the motive fluid, leads to an increase of the intrinsic energy of the motive fluid, which results for example in an increase of the temperature of the motive fluid. Secondly, the atoms or molecules of the suction fluid have an amount of kinetic energy which is directional and which, upon the merging with the motive fluid, leads to an increase of the kinetic energy of the motive fluid, which results for example in an increase of the flow speed of the motive fluid. In both cases, energy enrichment of the motive fluid is realized, which increases the efficiency of a power plant in which the nozzle module according to the invention can be used. Furthermore, the nozzle module according to the invention constitutes a device of simple structure, which is suitable for replacing complex and thus expensive devices and technologies according to the prior art. Aside from the introduction of energy into the motive fluid, an introduction of mass into the motive fluid also occurs. In a refinement of the invention, provision is made for the nozzle module according to the invention to be used in a power plant. In other words, the power plant comprises at least one nozzle module according to the invention.

According to the invention, it has proven to be particularly advantageous for the mixing chamber to be in the form of a receiving nozzle for the joint discharge of the motive fluid and of the suction fluid to a turbine. By means of the receiving nozzle, the motive fluid and the suction fluid are conducted in the same direction, in an energy-enriched fluid jet and in almost loss-free fashion to the turbine, which is possibly operatively connected to a dynamo-electric machine, for example a generator.

According to the invention, it has furthermore proven to be particularly advantageous for the introduction opening to be in the form of a second nozzle, the second nozzle being designed to evaporate the suction fluid during the introduction into the mixing chamber. Said change in the state of aggregation has the effect that the suction fluid which is liquid before flowing through the second nozzle and the suction fluid which is gaseous after flowing through the second nozzle converts energy by condensation.

Therefore, according to the invention, it is highly advantageously provided that the mixing chamber is designed to condense the suction fluid during the merging with the motive fluid. Thus, the energy stored in the suction fluid and transported by way of the suction fluid is released in the motive fluid, which results in an energy enrichment of the motive fluid. The driving force on which this process is based is the vapor pressure difference between the motive fluid and the suction fluid. After the condensing of the suction fluid in the motive fluid, the suction fluid has, in terms of state of aggregation, changed from liquid to gaseous and from gaseous to liquid.

According to the invention, it has proven to be particularly advantageous for the nozzle module to have a reservoir which is connected to the introduction opening and which is positioned upstream of the introduction opening and which serves for storing the suction fluid. The reservoir ensures a continuous flow of the suction fluid to the introduction opening, wherein the flow intensity is dependent on conditions of the nozzle module, on the fluids used and possibly on the power plant. The reservoir may be closed off with respect to the surroundings. In a first embodiment of the invention, the mixing chamber is arranged outside the reservoir. In a second embodiment of the invention, the mixing chamber is arranged within the reservoir. Furthermore, the arrangement of the mixing chamber within the reservoir may be configured such that an exchange of thermal energy takes place between the mixing chamber and the reservoir.

In a particularly advantageous refinement of the invention, it is provided that the mixing chamber is connected to the reservoir by way of a gap opening of adjustable form, the introduction opening being formed by the gap opening. In particular, the gap opening is in the form of a ring-shaped gap. This arrangement, which is radially symmetrical with respect to a longitudinal axis, running in the flow direction of the motive fluid, of the mixing chamber, leads to a cancelling-out of any deviation forces and moments that arise on and in the mixing chamber, which would otherwise lead to material fatigue and wear of the mixing chamber and would shorten the service life of the mixing chamber. Furthermore, the ring-shaped gap provides a flow pattern which is more laminar than a flow pattern of an introduction opening which is composed for example of multiple approximately punctiform and mutually separate individual introduction openings.

In this regard, according to the invention, it has proven to be particularly advantageous for the gap opening, in particular the ring-shaped gap, to be delimited at one side by an inner wall of the mixing chamber and at the other side by a circumferential surface of a plug which is mounted so as to be displaceable relative to the mixing chamber counter to an elastic restoring element. Thus, the position of the plug in the mixing chamber defines the dimension of the ring-shaped gap and thus the characteristic of the introduction opening. For example, if the mixing chamber and the reservoir are formed as one chamber, the plug may serve as a separation element which separates the mixing chamber and the reservoir from one another aside from the ring-shaped gap. If it is additionally the case that the restoring element is in the form of a spring, preferably helical spring and in particular tensile spring or compression spring, which is fastened at one side to the plug and at the other side to the reservoir, and the inner wall of the mixing chamber is of conical form relative to the longitudinal axis of the mixing chamber, a width of the ring-shaped gap and thus the characteristic of the introduction opening are defined not only by a characteristic curve of the spring but also by the pressure conditions in the mixing chamber and the reservoir. In the case of an optimum setup, the nozzle module according to the invention has a self-closing and self-opening action.

According to the invention, it is highly advantageously provided that a spacing of the first nozzle to a discharge opening of the mixing chamber is smaller than a spacing of the introduction opening to the discharge opening of the mixing chamber. In the context of the invention, the discharge opening of a nozzle or chamber is a constriction of the nozzle or chamber through which a fluid exits the nozzle or chamber. The nozzles according to the invention are preferably of convergent form, wherein, in particular, the receiving nozzle may have, opposite the discharge opening, a part of divergent form, also referred to as a diffuser. In the case of the arrangement according to the invention of the first nozzle and of the introduction opening relative to the discharge opening of the mixing chamber, the region downstream of the first nozzle, toward which the suction fluid is accelerated from the region downstream of the introduction opening, lies approximately in the direction of movement of the suction fluid, such that the directions of pulses of the motive fluid and of the suction fluid are oriented to be substantially the same direction, which leads to an addition of the pulses in terms of magnitude and thus to an increase of the flow speed of the merged fluid in the direction of the discharge opening of the mixing chamber.

According to the invention, it has proven to be particularly advantageous for the motive fluid to be water and for the suction fluid to be water, a temperature of the motive fluid upstream of the first nozzle being lower than a temperature of the suction fluid upstream of the introduction opening. Water as motive fluid and suction fluid is available in sufficient amounts at many locations and is non-critical in terms of handling. The vapor pressure difference that is required according to the invention between the motive fluid and the suction fluid may be provided most easily by way of water, which is as cold as possible for use as motive fluid and which is as hot as possible for use as suction fluid. The greater the temperature difference between the motive fluid and the suction fluid before an introduction into the nozzle module, the greater the energy input into the motive fluid, and the more pronounced the increase in efficiency of the power plant.

Furthermore, according to the invention, it is highly advantageously provided that an osmotic concentration of the motive fluid is higher than an osmotic concentration of the suction fluid. The osmotic concentration of a fluid is also referred to as osmolarity of the fluid. It describes the quantity of osmotically active particles per unit volume of the fluid, and is thus a measure of the osmotic pressure of the fluid. A difference between the osmotic concentration of the motive fluid and the osmotic concentration of the suction fluid likewise has a positive effect on the energy input into the motive fluid, and thus on the increase in efficiency of the power plant.

The nozzle module according to the invention is designed for use in a power plant, wherein the power plant may for example be a steam power plant, a thermal power plant, a geothermal power plant or an ocean thermal energy conversion (OTEC) power plant. As an alternative to this, it is also possible for the nozzle module according to the invention to be used in solar thermal plants, cooling plants and for the recovery of thermal energy from wastewater.

The invention will be described by way of example in two preferred embodiments and with reference to drawings, wherein further advantageous details emerge from the figures of the drawings.

Figure 2:
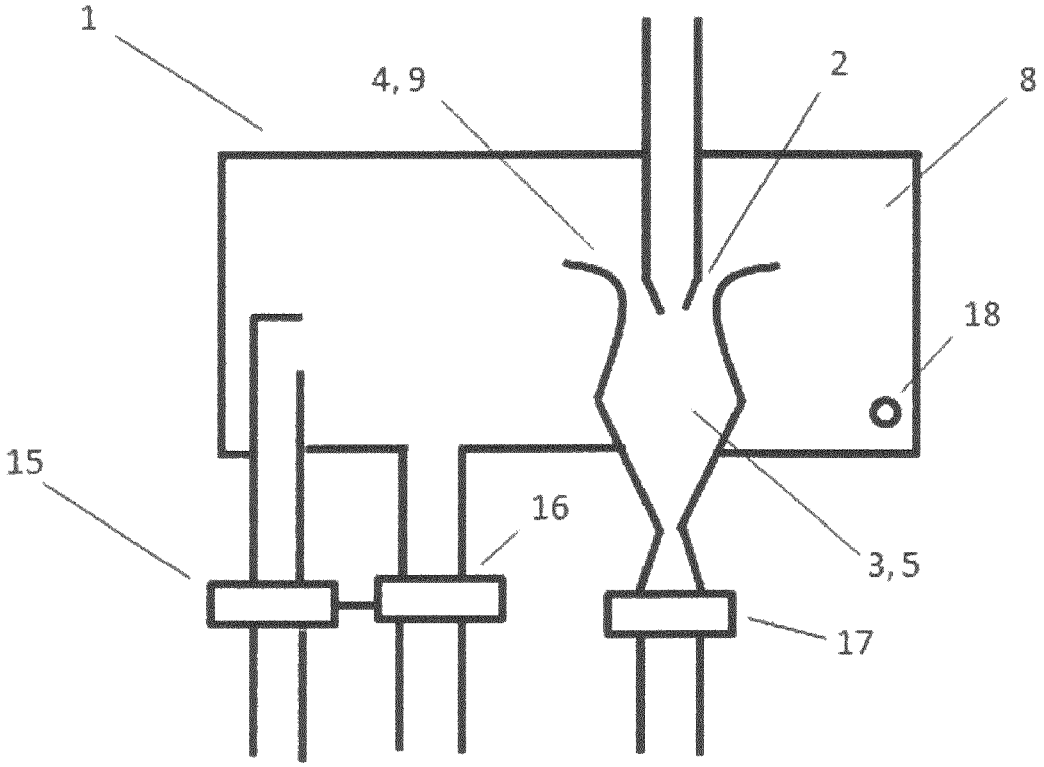

In detail, in the figures of the drawings:

FIG. 1 shows a schematic sectional view of a nozzle module according to a first embodiment of the invention; and FIG. 2 shows a schematic sectional view of a nozzle module according to a second embodiment of the invention.

FIG. 1 shows a schematic sectional view of a nozzle module 1 according to a first embodiment of the invention. The nozzle module 1 is provided for use in a power plant and comprises a first nozzle 2 for the introduction of a motive fluid into a mixing chamber 3 and comprises an introduction opening 4, in the form of a second nozzle, for the introduction of a suction fluid into the mixing chamber 3. The motive fluid is preferably cold water. The suction fluid is preferably hot water. The mixing chamber 3 is in the form of a receiving nozzle 5 for merging the motive fluid and the suction fluid in a flow-intensifying manner and for jointly discharging these to a turbine. For this purpose, the receiving nozzle 5 has a convergent part in which the first nozzle 2 and the second nozzle are arranged.

Downstream of a discharge opening 14 of the mixing chamber 3 in the form of a receiving nozzle 5, the receiving nozzle 5 has a divergent part, which forms a diffuser and which serves for the discharge of the motive fluid and of the suction fluid to the turbine. It is essential to the invention that a vapor pressure of the motive fluid upstream of the first nozzle 2 is lower than a vapor pressure of the suction fluid upstream of the second nozzle, and a gas pressure in the mixing chamber 3 in a region 6 downstream of the first nozzle 2 is lower than a gas pressure in the mixing chamber 3 in a region 7 downstream of the second nozzle. The suction fluid evaporates during the introduction into the mixing chamber 3 through the second nozzle. During the merging with the motive fluid, the suction fluid condenses in the motive fluid in the receiving nozzle 5. The nozzle module 1 has a reservoir 8 which is connected to the introduction opening 4 in the form of second nozzle and which is positioned upstream of the introduction opening 4 and which serves for storing the suction fluid. In the first embodiment, the mixing chamber 3 is arranged outside the reservoir 8. The mixing chamber 3 is connected to the reservoir 8 by way of a gap opening 9 which is of adjustable form and which is in the form of a ring-shaped gap, the second nozzle being formed by the ring-shaped gap. The ring-shaped gap is delimited at one side by an inner wall 10 of the mixing chamber 3 and at the other side by a circumferential surface 11 of a plug 13 which is mounted so as to be displaceable relative to the mixing chamber 3 counter to an elastic restoring element 12. The elastic restoring element 12 is in the form of a helical spring which can be subjected to tensile load. A spacing of the first nozzle 2 to a discharge opening 14 of the mixing chamber 3 in the form of receiving nozzle 5 is smaller than a spacing of the introduction opening 4 in the form of second nozzle to the discharge opening 14 of the mixing chamber 3 in the form of receiving nozzle 5. Thus, the evaporated suction fluid, on its acceleration path in the direction of the receiving nozzle 5, impinges on the motive fluid, in which said suction fluid condenses and into which said suction fluid introduces its energy. The receiving nozzle 5 or mixing chamber 3 is of radially symmetrical form with respect to a longitudinal axis running in the flow direction of the motive fluid, and has a conical region at the level of the plug 13. A width of the ring-shaped gap is adjustable by way of an axial position, in relation to the longitudinal axis, of the plug 13 relative to the receiving nozzle 5. The receiving nozzle 5 has a smaller radius in its convergent part in the region 6 downstream of the first nozzle 2 than in the region 7 downstream of the second nozzle. A pipe piece arranged in the mixing chamber 3 for the purposes of introducing the motive fluid into the first nozzle 2 is of cylindrical form. A pipe piece arranged in the reservoir 8 for the purposes of introducing the motive fluid into the first nozzle 2 has a corrugated bellows in order to provide axial displaceability, in relation to the longitudinal axis, of the plug 13.

FIG. 2 shows a schematic sectional view of a nozzle module 1 according to a second embodiment of the invention. The nozzle module 1 is of similar construction to the nozzle module 1 illustrated in FIG. 1, and likewise has a reservoir 8 which is connected to the introduction opening 4 in the form of second nozzle and which is positioned upstream of the introduction opening 4 in the form of second nozzle and which serves for storing the suction fluid. The mixing chamber 3 is in the form of a receiving nozzle 5 for jointly discharging the motive fluid and the suction fluid to a turbine 17. However, in the second embodiment, the mixing chamber 3 is arranged within the reservoir 8. The reservoir 8 is closed off with respect to the surroundings. The reservoir 8 and the mixing chamber 3 arranged therein are generally designed such that an exchange of thermal energy can take place between the reservoir 8 and the mixing chamber 3.

Furthermore, the reservoir 8 comprises a feed line, which has a pressure exchanger 15, and a discharge line, which has a negative-pressure pump 16, for the feed and discharge of the suction fluid respectively, wherein the negative-pressure pump 16 is operatively connected to the pressure exchanger 15. The negative-pressure pump 16 generates, in the reservoir 8, a negative pressure which draws the suction fluid into the reservoir 8 through the feed line. The temperature of the suction fluid is measured by way of a temperature sensor 18 fastened to the reservoir 8, wherein the measured temperature is taken into consideration in the control of the negative-pressure pump 16.

LIST OF REFERENCE DESIGNATIONS

1 Nozzle module
2 First nozzle
3 Mixing chamber
4 Introduction opening
5 Receiving nozzle
6 Region
7 Region
8 Reservoir
9 Gap opening
10 Inner wall
11 Circumferential surface
12 Restoring element
13 Plug
14 Discharge opening
15 Pressure exchanger
16 Negative-pressure pump
17 Turbine
18 Temperature sensor

The invention claimed is:

1. A nozzle module (1) for an energy converter, comprising a first nozzle (2) for the introduction of a motive fluid into a mixing chamber (3) and comprising an introduction opening (4) for the introduction of a suction fluid into the mixing chamber (3), the mixing chamber (3) having a geometry for merging the motive fluid and the suction fluid in the mixing chamber (3) in a flow-intensifying manner, wherein a vapor pressure of the motive fluid upstream of the first nozzle (2) is lower than a vapor pressure of the suction fluid upstream of the introduction opening (4), and a gas pressure in the mixing chamber (3) in a region (6) downstream of the first nozzle (2) is lower than a gas pressure in the mixing chamber (3) in a region (7) downstream of the introduction opening (4), wherein the motive fluid is water and the suction fluid is water, wherein the nozzle module (1) comprises a reservoir (8) adapted for storing the suction fluid, wherein the mixing chamber (3) is connected to the reservoir (8) by way of a gap opening (9) of adjustable form, the introduction opening (4) being formed by the gap opening (9).

2. The nozzle module (1) as claimed in claim 1, wherein the mixing chamber (3) is in the form of a receiving nozzle (5) for the joint discharge of the motive fluid and of the suction fluid to a turbine (17).

3. The nozzle module (1) as claimed in claim 1, wherein the introduction opening (4) is in the form of a second nozzle, the second nozzle being designed to evaporate the suction fluid during the introduction into the mixing chamber (3).

4. The nozzle module (1) as claimed in claim 1, wherein the mixing chamber (3) is designed to condense the suction fluid during the merging with the motive fluid.

5. The nozzle module (1) as claimed in claim 1, wherein the reservoir (8) is connected to the introduction opening (4) and positioned upstream of the introduction opening (4).

6. The nozzle module (1) as claimed in claim 1, wherein the gap opening (9) is delimited at one side by an inner wall (10) of the mixing chamber (3) and at the other side by a circumferential surface (11) of a plug (13) which is mounted so as to be displaceable relative to the mixing chamber (3) counter to an elastic restoring element (12).

7. The nozzle module (1) as claimed in claim 1, wherein a spacing of the first nozzle (2) to a discharge opening (14) of the mixing chamber (3) is smaller than a spacing of the introduction opening (4) to the discharge opening (14) of the mixing chamber (3).

8. The nozzle module (1) as claimed in claim 1, a temperature of the motive fluid upstream of the first nozzle (2) being lower than a temperature of the suction fluid upstream of the introduction opening (4).

9. The nozzle module (1) as claimed in claim 1, wherein an osmotic concentration of the motive fluid is higher than an osmotic concentration of the suction fluid.

* * * * *